United States Patent [19]

Shimonosono et al.

[11] Patent Number: 4,520,768

[45] Date of Patent: Jun. 4, 1985

[54] CYLINDER BLOCK OF INTERNAL COMBUSTION ENGINE

[75] Inventors: Hitoshi Shimonosono, Yokosuka; Naoki Ogawa; Yoshinori Hirano, both of Yokohama, all of Japan

[73] Assignee: Nissan Motor Co., Ltd., Yokohama, Japan

[21] Appl. No.: 649,505

[22] Filed: Sep. 11, 1984

[30] Foreign Application Priority Data

Sep. 13, 1983 [JP] Japan ..... 58-140864[U]

[51] Int. Cl.[3] ..... F01P 3/02

[52] U.S. Cl. ..... 123/41.44; 123/41.74; 123/193 C

[58] Field of Search ..... 123/41.02, 41.44, 41.72, 123/41.74, 41.12, 193 C, 193 CH, 41.79

[56] References Cited

U.S. PATENT DOCUMENTS

| | | | |
|---|---|---|---|
| 1,787,562 | 1/1931 | Barlow | 123/41.44 |
| 2,056,622 | 10/1936 | Schaer | 123/41.74 |
| 4,470,376 | 9/1984 | Hayashi | 123/41.74 |

FOREIGN PATENT DOCUMENTS

| | | | |
|---|---|---|---|
| 299551 | 3/1916 | Fed. Rep. of Germany | 123/41.79 |
| 982469 | 6/1951 | France | 123/41.79 |
| 55-46066 | 3/1980 | Japan | 123/193 C |

*Primary Examiner*—William A. Cuchlinski, Jr.

*Attorney, Agent, or Firm*—Schwartz, Jeffery, Schwaab, Mack, Blumenthal & Evans

[57] ABSTRACT

To increase the structural rigidity of outer walls of a cylinder block wherein the coolant jacket thereof is adapted to receive coolant in a liquid state and discharge same in a gaseous state, a measure is employed wherein walls of the cylinders are integrally connected at their peripheral portions and a plurality of ribs are disposed in the coolant jacket with their laterally opposed sides integrally connected with the cylinder walls and the outer walls. Each rib extends essentially along the length of the cylinders from the bottom portion of the coolant jacket thereby to form a plurality of cells in the coolant jacket.

6 Claims, 4 Drawing Figures

CYLINDER BLOCK OF INTERNAL COMBUSTION ENGINE

BACKGROUND OF THE INVENTION

1. Field of the Invention

The present invention relates to an internal combustion engine which is cooled by a so-called boiling liquid cooling system, and more particularly to an improved cylinder block for such engine wherein coolant is introduced thereinto in a liquid state and exhausted therefrom to a heat exchanger in a gaseous state.

2. Description of the Prior Art

Hitherto, there has been proposed a so-called boiling liquid cooling system (viz., evaporative cooling system) for cooling an internal combustion engine. This type cooling system basically features an arrangement wherein a liquid coolant (water) in the coolant jacket of the engine is permitted to boil and the gaseous coolant thus produced is passed out to an air-cooled heat exchanger or condenser where the gaseous coolant is cooled or liquefied and then recirculated back into the coolant jacket of the engine. Due to the effective heat exchange effected between the gaseous coolant in the condenser and the atomosphere surrounding the condenser, the cooling system exhibits a very high performance. Japanese Patent Application Second Publication Sho No. 57-57608 and Japanese Patent Application Sho No. 58-86632 show some examples of the above-mentioned cooling systems. Furthermore, copending U.S. patent application No. 602,451 filed on Apr. 20, 1984 in the name of Yoshimasa Hayashi shows another example of such cooling system.

However, as will become apparent as the description proceeds, the previously proposed systems are constructed without paying any regard to reduction in engine noise. That is to say, the internal combustion engines equipped with such type cooling system have inevitably produced a considerable engine noise due to a non-rigid construction of the cylinder block of the engine proper.

SUMMARY OF THE INVENTION

It is therefore an object of the present invention to provide an improved cylinder block which is rigidly constructed and exhibits excellent noise damping performance when applied to an internal combustion engine.

In accordance with the present invention, there is provided in an internal combustion engine including a structure defining aligned cylinders, walls of the cylinders which are integrally connected at their peripheral portions, outer walls which surround the cylinder walls to form therebetween a coolant jacket into which the coolant is introduced in a liquid state and from which the coolant is discharged in a gaseous state, first means for maintaining the level of the liquid coolant in the coolant jacket at such a level as to entirely cover the cylinder walls, second means for controlling condensation of the gaseous coolant issued from the coolant jacket in accordance with the temperature of the liquid coolant in the coolant jacket, a plurality of spaced ribs disposed in the coolant jacket with their laterally opposed sides integrally connected with the cylinder walls and the outer walls, the ribs extending essentially along the length of the cylinders from the bottom portion of the coolant jacket thereby to form a plurality of cells in the coolant jacket, and third means for providing a fluid communication between the cells.

BRIEF DESCRIPTION OF THE DRAWINGS

Other objects and advantages of the present invention will become apparent from the following description when taken in conjunction with the accompanying drawings, in which.

DESCRIPTION OF EVAPORATIVE COOLING SYSTEM

Figure 1:
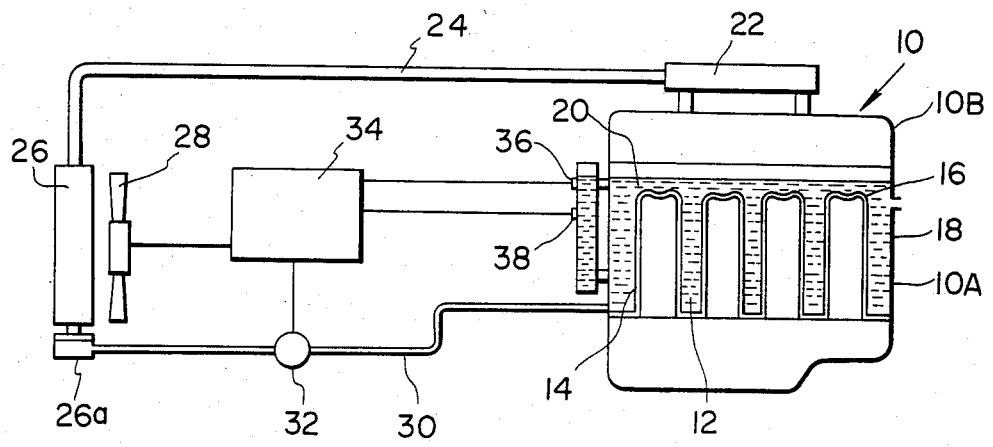
FIG. 1 is a schematical illustration of an evaporative cooling system practically applied to an internal combustion engine.
Figure 2:
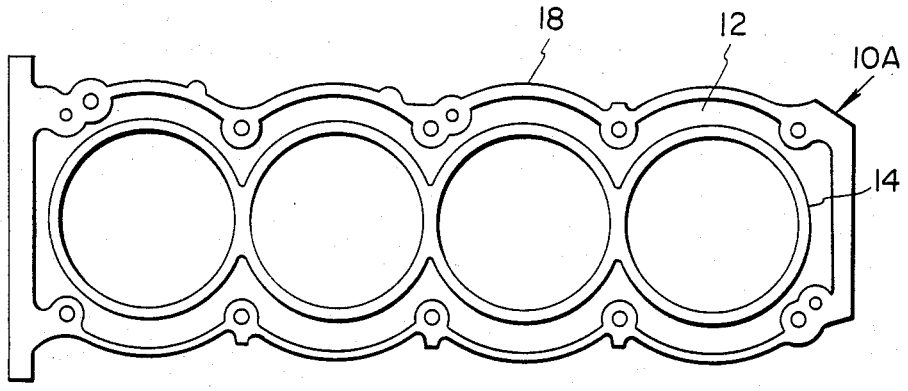
FIG. 2 is a horizontally sectional view of a cylinder block which is employed in the previously proposed evaporative cooling system.

Prior to describing in detail the cylinder block of the present invention, the boiling liquid cooling system shown in the afore-mentioned U.S. patent application No. 602,451 will be outlined with reference to FIGS. 1 and 2 in order to clarify the present invention.

Referring to FIG. 1, there is shown the previously proposed boiling liquid cooling system which is practically applied to an internal combustion engine. The engine proper 10 comprises a cylinder block 10A and a cylinder head 10B which are united to define therein a coolant jacket 12. The coolant jacket 12 is substantially enclosed by cylinder walls 14, combustion chamber walls 16 and outer walls 18 of the engine 10. The coolant jacket 12 contains a liquid coolant (water) 20 which boils under operation of the engine 10. The gaseous coolant (vapor) thus produced is temporally collected in a collector 22 from which the gaseous coolant is then introduced through a passage 24 to a condenser 26 where the coolant is condensed by radiating heat. The condenser 26 is located at the place where natural air draft is generated under cruising of the vehicle. An electric fan 28 is positioned near the condenser 26 to produce, upon energization thereof, an air flow which passes over the condenser 26. The coolant thus liquefied in the condenser 26 is then returned through a passage 30 to the coolant jacket 12 by work of an electric feed pump 32.

The operation of the cooling system is controlled by an electric control system. The electric control system comprises a control unit 34 into which information signals issued from a liquid level sensor 36 and a liquid temperature sensor 38 are fed. The level sensor 36 detects a predetermined level of the liquid coolant 20 in the coolant jacket 12, while, the temperature sensor detects a predetermined temperature of the coolant 20. Instruction signals produced by the control unit 34 in accordance with the information signals are applied to the electric feed pump 32 and the electric fan 28 in such a manner that when the level of the liquid coolant in the coolant jacket 12 becomes lower than the predetermined level, the electric feed pump 32 is energized to feed the liquid coolant in the lower tank **26*a* of the condenser 26 into the coolant jacket 12 of the engine proper 10 and that when the temperature of the coolant in the coolant jacket 12 becomes higher than the predetermined degree, the electric fan 28** is energized to produce air flow thereby to promote the condensating function of the condenser 26. With this, under operation of the engine, the level of the liquid coolant in the coolant jacket 12 is kept at the predetermined level and the temperature of the liquid coolant in the jacket 12 is kept at a desired degree. In order to more precisely control the cooling system, engine speed and engine load may be employed as the factors for determining the instruction signals applied to the electric feed pump 32 and the electric fan 28.

Referring to FIG. 2, there is shown the cylinder block 10A of the engine 10 of FIG. 1, that is, the cylinder block disclosed by U.S. patent application No. 602,451. As is understood from this drawing, the cylinder block 10A disclosed in that application is of the type which is usually employed in a conventional water-cooled engine, that is, of the cylinder block the water jacket of which is designed to achieve smooth water flow therethrough. That is, the water jacket of the cylinder block 10A has a voluminous and simple construction for reducing the resistance thereof against the water flow.

However, as is known to those skilled in the art, the voluminous and simple construction of the water jacket can not provide the cylinder block, particularly, the outer walls of the same, with a sufficiently rigid construction. Thus, under operation of the engine, the outer walls of the cylinder block tend to effect membrane vibration (diaphragm-like inward and outward flexture) with a considerable noise. That is, the evaporative cooling system proposed by the above-mentioned application produces inevitably a considerable engine noise like in the case of the conventional water-cooled engines.

DETAILED DESCRIPTION OF THE INVENTION

Figure 3:
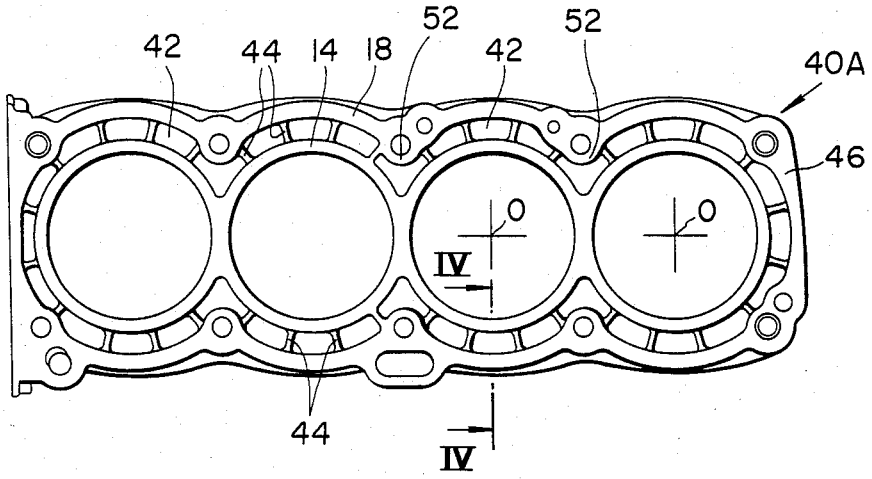
FIG. 3 is a view similar to FIG. 2, but showing a cylinder block according to the present invention.
Figure 4:
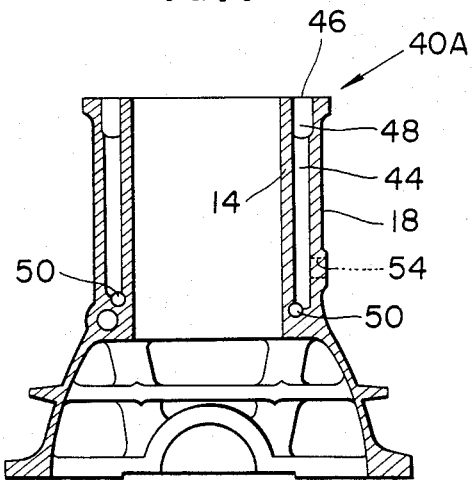
FIG. 4 is a sectional view taken along the line IV—IV of FIG. 3.

Referring to FIGS. 3 and 4, there is shown a cylinder block 40A according to the present invention, which is free of the above-mentioned undesirable phenomenon. The substantially same parts and constructions as those in the above-mentioned arrangement are designated by the same numerals. As is seen from FIG. 3, the cylinder walls 14 are integrally connected to one another at their peripheral portions to form aligned and merged cylinders (four cylinders in the illustrated example). Outer walls 18 of the cylinder block 40A surround the cylinder walls 14 to define therebetween a coolant jacket 42.

A plurality of web-like ribs 44 are formed between and integral with the cylinder walls 14 and the outer walls 18 and thus a plurality of cells (no numerals) are defined in the coolant jacket 42, as shown. The ribs 44 extend in the radial directions with respect to the axes of the associated cylinders. The ribs 44 on each cylinder are arranged at equally spaced intervals except at the positions or position where the cylinder wall is integrated with the adjacent cylinder walls or wall. Preferably, each two of the ribs 44 are arranged at the diametrically opposed positions with respect to the axis of the associated cylinder for the purpose which will become clear hereinafter. As will be seen from FIG. 4, each rib 44 extends vertically from the bottom of the coolant jacket 42 and terminates short of the upper deck 46 of the cylinder block 40A thereby to form a recess 48 above the rib 44. An opening 50 is formed in the lowermost end of each rib 44. By the provision of the recess 48 and the opening 50 in each rib 44, all cells of the coolant jacket 42 are fluidly connected. If desired, the ribs 44 may be constructed to extend to the upper deck 46 so long as the fluid communication between the cells is assured by the openings 50. The opening 50 of each rib 44 may be provided by terminating the rib at the position short of the bottom of the coolant jacket 42, like the case of the recess 48.

As is seen from FIG. 3, the outer walls 18 of the cylinder block 40A are formed at the junction portions of the neighbouring cylinders with inwardly projected portions 52 which serve as boss portions for head bolts. Some of the ribs 44 are integrally connected to the boss portions 52. As is seen in FIG. 4, a hole 54 is formed in the outer wall 18, through which a liquid coolant is fed into the coolant jacket 42.

With the above-mentioned construction of the cylinder block 40A, the following advantages are obtained:

The cylindrical nature of the cylinder walls 14 endows on same a relatively high rigidity which when connected with the outer walls 18 of the cylinder block 40A secures same against diaphragm-like inward and outward flexture. The disposition of the ribs 44 in diametrically arranged pairs serves to increase the structural rigidity of the arrangement. Furthermore, the integral connection between the neighbouring cylinder walls 14 and that between the boss portions 52 of the outer walls 18 and the cylinder walls 14 also serve to increase the rigidity of the arrangement. Because of the increase in structural rigidity of the cylinder block 40A, the membrane vibration of the outer walls 18 is minimized thereby greatly reducing the noise produced by the engine. This increased rigidity exhibits its remarkable noise-reduction performance when applied to a cylinder block having an open type upper deck.

Another important advantage derived with this arrangement is that the ribs 44 serve to conduct heat away from the cylinder walls 14 and transmit same toward the outer walls 18. Accordingly, as the cylinder block 40A per se has a high heat accumulating capacity and the ribs 44 provide an increased surface area through which heat may be transmitted to the coolant, the cooling efficiency of the arrangement is notably increased. In this connection, the equally spaced disposition of the ribs 44 in the coolant jacket 42 induces equal heat transmission of same thereby achieving uniformed temperature distribution of the cylinder block 40A therethroughout.

The radial arrangement of the ribs 44 in the coolant jacket 42 induces that the integral connection between the cylinder walls 14 and the outer walls 18 is achieved by the shortest ribs 44. Thus, dicasting of the cylinder block can be carried out easily with minimized weight increase of same.

In the evaporative cooling system, the circulation of the liquid coolant in the coolant jacket is quite small as compared with the conventional water cooled type system. Thus, even though the coolant jacket 42 is divided into a plurality of small cells as in the case of the present invention, the flow of the liquid coolant in the jacket 42 is achieved by only the connecting openings 50 without difficulty. Furthermore, the provision of the connecting openings 50 has a function to prevent sudden boiling of the liquid coolant which obstructs the heat transmission from the cylinder walls 14. That is, when the liquid coolant is brought into the sudden boiling condition, relatively cold liquid coolant is fed to the coolant jacket 42 from the connecting openings 50. Thus, the undesirable sudden boiling of the liquid coolant is suppressed or at least minimized.

When the liquid coolant in the coolant jacket 42 boils and evaporates, the vapor thus produced moves upwardly. In the invention, the upward movement of the vapor is smoothly achieved because the ribs 44 are constructed to extend vertically.

Furthermore, the provision of the recesses 48 at the upper portions of the ribs 44 serves to prevent stagnation of vapor at the upper portions of the coolant jacket. With this, the pressures in the cells are kept substantially equal to each other.

However, the present invention is not limited to the above-mentioned construction. If desired, as is described hereinafore, the ribs 44 may be arranged to be flush with the surface of the upper deck 46 so as to cause the vapor to be exhausted from the respective cells. Furthermore, when the invention is applied to an engine having more than four cylinders, the ribs 44 associated with each 2nd and 3rd cylinders may be formed to be flush with the surface of the upper deck 46 so that the vapor produced in the cells surrounding the 2nd and 3rd cylinders is exhausted together.

In the above-mentioned construction, the ribs 44 are arranged around the associated cylinder walls at equally spaced intervals. However, if desired, in order to increase the structural rigidity of the portions of the outer walls 18 where the membrane vibration tends to occur particularly, the number of the ribs 44 applied to such portions may be increased. Although the ribs 44 described hereinabove are of elongated flat members each extending vertically and continuously, the ribs are not limited to such flat members and they can take any desired shapes so long as the above-mentioned advantageous effects are assured. For example, each rib may be divided into two or three parts in the vertical direction.

What is claimed is:

1. In an internal combustion engine including a structure defining aligned cylinders, walls of said cylinders which are integrally connected at their peripheral portions;

outer walls which surround said cylinder walls to form therebetween a coolant jacket into which the coolant is introduced in a liquid state and from which the coolant is discharged in a gaseous state;

first means for maintaining the level of the liquid coolant in the coolant jacket at such a level as to entirely cover the cylinder walls;

second means for controlling condensation of the gaseous coolant issued from said coolant jacket in accordance with temperature of the liquid coolant in the coolant jacket;

a plurality of spaced ribs disposed in said coolant jacket with their laterally opposed sides integrally connected with said cylinder walls and said outer walls, said ribs extending essentially along the length of the cylinders from the bottom portion of the coolant jacket thereby to form a plurality of cells in said coolant jacket; and third means for providing a fluid communication between the cells.

2. An internal combustion engine as claimed in claim 1, in which said third means comprises an opening formed in the lowermost portion of each rib through which adjacent two cells are fluidly connected.

3. An internal combustion engine as claimed in claim 2, in which said ribs extend in radial directions with respect to the axes of the associated cylinders.

4. An internal combustion engine as claimed in claim 3, in which each two of said ribs are arranged in a diametrically opposed relationship with one and other.

5. An internal combustion engine as claimed in claim 4, in which said ribs are arranged about the cylinder walls at equally spaced intervals except at the position where the cylinder walls are integrated.

6. An internal combustion engine as claimed in claim 2, in which said third means further comprises a recess formed at the uppermost portion of each rib through which adjacent two cells are fluidly connected.

* * * * *